United States Patent [19]

Lundholm

[11] 4,386,441

[45] Jun. 7, 1983

[54] FOLDING PONTOON ARRANGEMENT

[76] Inventor: Frans G. Lundholm, Storgatan 96, S-90244 Umeå, Sweden

[21] Appl. No.: 233,468

[22] Filed: Feb. 11, 1981

[30] Foreign Application Priority Data

Feb. 19, 1980 [SE] Sweden ..... 8001308

[51] Int. Cl.[3] ..... E01D 15/14

[52] U.S. Cl. ..... 14/27; 14/2.6; 405/220

[58] Field of Search ..... 14/2.6, 27; 405/202, 405/219, 220, 221

[56] References Cited

U.S. PATENT DOCUMENTS

| | | | |
|---|---|---|---|
| 3,010,128 | 11/1961 | Gillois | 14/27 X |
| 3,043,109 | 7/1962 | Erickson | 405/220 |
| 3,152,569 | 10/1964 | Gehlen | 14/2.6 X |
| 3,613,139 | 10/1971 | Hansgen | 14/2.6 |
| 3,824,796 | 7/1974 | Nasby | 405/220 |

OTHER PUBLICATIONS

Swedish and British Army Photographic Copies Supplied by Applicant.

*Primary Examiner*—Nile C. Byers, Jr.

*Attorney, Agent, or Firm*—Stevens, Davis, Miller & Mosher

[57] ABSTRACT

A folding pontoon arrangement comprises one, or preferably two pairs of pontoons. The pontoons in each pontoon pair are mutually, pivotably connected about a hinge line at the upper side of the pontoons. One of the pontoons of each pair has a chamber situated below the hinge line, which can be opened to the outside of the pontoon via a closable connection. The second pontoon in the pontoon pair has a wheel housing with a ground wheel mounted therein under the hinge line. When the pontoon pair assumes an extended floating position and the connection is then opened, the chamber is filled with water causing the pontoon pair to fold about the hinge line. The weight of the wheel contributes to the folding tendency. If two pontoon pairs are pivotably interconnected with the aid of a third hinge joint, a pontoon unit is obtained which is a self-contained vehicle on the wheels when the pontoons are locked together in an upstanding, juxtaposed position.

9 Claims, 3 Drawing Figures

FOLDING PONTOON ARRANGEMENT

Figure 1:
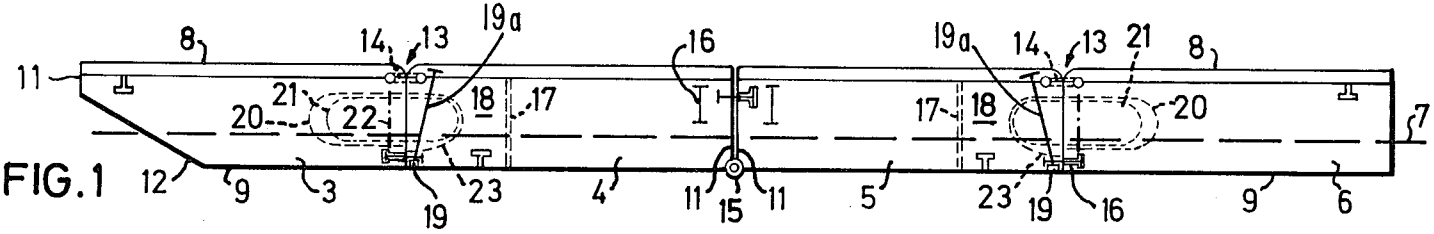

The present invention relates to a folding pontoon arrangement comprising at least one pair of pontoons with an upper side forming a carrying surface, and an underside intended to be submerged in the water, said pontoons being pivotably interconnected for swinging about a hinge line adjacent the plane of the upper sides, said line being parallel to the upper sides and to the mutually opposing end walls of the pontoons. Such pontoon arrangements are utilized for pontoon bridges, for example, or as rafts and ferries. In both cases a plurality of pontoon pairs are connected together.

In a known embodiment of a pontoon arrangement, the individual pontoons are arranged in units comprising two pontoon pairs, and these pairs are pivotably interconnected along a hinge line pivot means which is parallel to the hinge lines of the two pontoon pairs but situated on the undersides of the pontoons. From its extended floating position, such a pontoon unit can be folded together like a W to a transport position in which the pontoons are upstanding in vertical juxtaposition. In this transport position the pontoon unit can then be transported by truck. A crane is required for launching and retrieving onto the truck. A crane is also needed for folding up the pontoon unit from its extended floating position, and this causes loading and unloading the pontoon units to be complicated. Only one pontoon unit can normally be loaded on a truck. When rapid transport of pontoon bridge materiel is desired, there is thus the need for just as many trucks as the number of pontoon units comprising the bridge. A separate crane is furthermore required if each of the trucks is not provided with a crane.

The object of the present invention is to improve a pontoon arrangement of the kind described above so that retrieving, launching and transport of the pontoons in such an arrangement are substantially facilitated and can be carried out without sophisticated transport equipment.

According to the invention, this is achieved with a pontoon arrangement characterized in that one of the pontoons in each pair has an internal chamber sealed from the rest of the pontoon, said chamber being situated against the end wall adjacent the hinge line pivot means of the pontoon, and that there is a closable opening (valve) on the outside of the pontoon at a place under the water surface in the floating position of the pontoon. When the pontoons assume their floating position and the chamber is filled with air, this chamber forms a floating body as with remaining portions of the pontoon. If the valve is opened with the pontoon in this position, water flows into the chamber, to cause loss of buoyancy under the hinge connection between the individual pontoons. This portion thus sinks down into the water and initiates the folding process of the pontoon pair. A crane is thus not required for this purpose.

The folding of the pontoon pair is facilitated if, in accordance with a further development of the invention, at least one of the pontoons is provided with a weight situated adjacent the side wall under the hinge line pivot means.

In a preferred embodiment of the invention, the weight is formed by at least one wheel. This wheel is suitably so arranged that when the pontoon pair is folded, the wheel projects outside the end wall of one pontoon, so that the pontoon pair can rest on the wheel.

When the pontoon pair assumes an extended floating position, the wheel thrusts into a recess in the other pontoon in the pair. If two pontoon pairs are interconnected, and each provided with at least one wheel according to the above, the pontoon unit thus formed can rest on these wheels when it is in a folded position. The pontoon unit can thus be transported as a trailer behind an optional towing vehicle, which also signifies that it can be pulled up out of the water with its wheels rolling along the shore or up a simple ramp, whereby the need of a crane and special trucks is eliminated.

Figure 2:
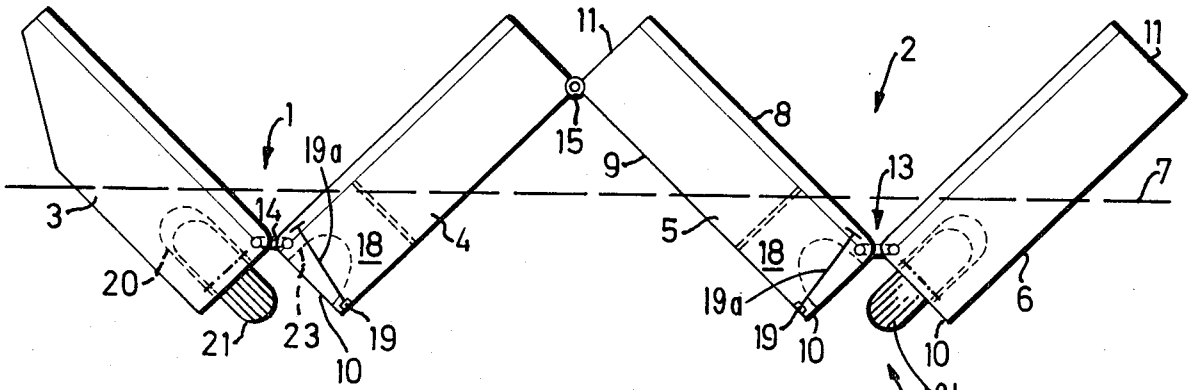
Figure 3:
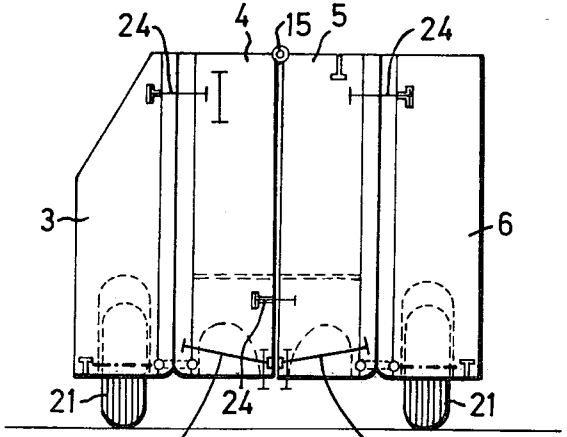

An embodiment example of a pontoon arrangement in accordance with the invention will now be described in detail while referring to the accompanying drawings, in which FIG. 1 illustrates a pontoon unit comprising two pontoon pairs, seen from one side in an extended floating position, FIG. 2 illustrates the pontoon unit during folding, and FIG. 3 illustrates the pontoon unit in a folded transport position.

The pontoon unit comprises two pontoon pairs 1 and 2. Each pontoon pair 1,2 consists of two pontoons 3,4 and 5,6 respectively. In the position illustrated in FIG. 1, the pontoon pairs are extended one after the other in the floating position, the water surface being indicated by the dashed line 7. The pontoons 3–6 have a flat upper side 8 forming the carrying surface or roadway, a similarly flat underside 9 and substantially vertical side walls. In each pontoon pair 1 and 2 the juxtaposed side walls or end walls are denoted by the numeral 10, and the side walls along the outsides of the pontoon pair by the numeral 11. As will be seen from the drawing, the pontoon 3 is chamfered off between the end wall 11 and the underside 9 to form a prow or landing ramp 12.

Both pontoons 3,4 and 5,6 in each pontoon pair 1,2 are pivotably interconnected at the juncture between the upper side 8 and the end wall 10. The hinge line pivot means 13 thus formed is divided into two juxtaposed hinge lines with the aid of connecting links 14, whereby there is no obstruction caused by hinge details projecting up above the upper sides 8 of the pontoons. The juxtaposed pontoons 4 and 5 in the two pontoon pairs 1 and 2 are pivotably connected to each other at a hinge line pivot means 15 parallel to the hinge line pivot means 13 and situated at the juncture between the end walls 11 and the undersides 9.

In the floating position illustrated in FIG. 1, the pontoons 3/4, 4/5 and 5/6 are mutually connected by means of a first set of locking means 16 formed as slings or links for example, to prevent the pontoons unintentionally pivoting about the hinge line pivot means 13,15.

According to the invention, a pontoon 4,5 in each pontoon pair 1 and 2 is internally divided by means of an intermediate wall 17 such that a chamber 18, separate from the rest of the pontoon, is formed against the end wall 10. By means of a closable opening, the chamber can be put in communication with the outside of the pontoon at a place under the water surface when the pontoon is in its floating position. The closable opening may comprise, for example, an opening provided with a valve in the underside 9 adjacent the end wall 10, this being schematically illustrated in the drawing by a rectangle 19.

The outer pontoon 3 and 6 in each pontoon pair 1,2 has a wheel housing 20 made in the end wall 10, a wheel 21 being mounted in said housing on a shaft 22 which is attached to the pontoon at right angles to the upper and under sides 8,9. To advantage, two wheels 21 are arranged in tandem on a bogie suspension in each pontoon 3 and 6. The shafts 22 are situated close to the end walls 10, and a portion of each wheel 21 thus projects outside the respective wall. In the extended floating position of the pontoon unit illustrated in FIG. 1, these projecting portions of the wheels 21 are accommodated in complementary recesses 23 made in the end wall 10 of the adjacent pontoon 4,5.

When the pontoon unit is to be folded up from the extended floating position illustrated in FIG. 1, the locking means 16 are released and the valves 19 opened. Water then begins to flow into the chamber 18. This portion of the pontoon 4 and 5 respectively thus sinks deeper into the water, and the pontoons begin to pivot about the hinge line pivot means 13 and 15. This movement is facilitated if the pontoons are provided with weights situated under the hinge line pivot means 13. In the illustrated embodiment of the pontoon pair, these weights are formed by the wheels 21 and the wheel recesses 20,23. The pontoon unit is folded together under the action of these weights and the lost buoyancy in the chambers 18, from the extended position shown in FIG. 1, via the partially folded position shown in FIG. 2, to a position in which the pontoons are in upstanding juxtaposition, as shown in FIG. 3. In this folded-up position the pontoons 3/4, 4/5 and 5/6 are interlocked with the aid of a second set of locking means 24, which can also be formed as slings or links. The pontoon unit thus folded together can now be pulled up onto land, rolling on the wheels 21, and can be transported on land as a self-supporting trailer. The pontoon unit will be provided with a suitable towing bar (not shown) for this purpose. When the pontoon unit has been pulled up on land, water flows out of the chambers 18 via the opened valves 19. These valves can be closed when the chambers 18 are empty.

When the pontoon unit is to be launched once again, it is rolled out into the water on its wheels 21 until it floats, whereafter the locking means 24 are released. The pontoons 3–6 will then automatically open out and lay substantially flat in the water. The last swing out to the flat, extended floating position shown in FIG. 1 can be provided e.g by the first locking means 16 being utilized as pulling means. During launching, the valves 19 must be closed, so that the chambers 18 are kept filled with air. To facilitate opening these connections when the pontoon unit is once again to be folded up, the valves should be operable from the upper side of the pontoons.

What I claim is:

1. A folding pontoon arrangement comprising at least one pair of interconnecting pontoons, each pontoon having an upper side forming a carrying surface, an underside intended to be submerged in the water, end walls, one end of each pontoon of which mutually opposes the other and side walls and hinge line pivot means adjacent the upper sides and mutually opposed end walls pivotally interconnecting said pontoons for swinging about said means, one of said pontoons defining a chamber having a side which includes one of said mutually opposed end walls, said chamber having a closable opening therein adjacent said underside to permit and prevent entry and exiting of water to and from said chamber.

2. The arrangement as in claim 1 wherein said closable opening, comprises a shut-off valve.

3. The arrangement as claimed in claim 2, wherein said valve is operable from the top and/or side of the pontoon.

4. The arrangement as claimed in claim 1, wherein at least one of the pontoons in each pair is provided with a weight situated in the vicinity of one of said mutually opposing end walls.

5. The arrangement as claimed in claim 4, wherein said weight is at least in part formed by at least one wheel.

6. The arrangement as claimed in claim 5, wherein said wheel is partially inserted in a wheel housing made from one of said mutually opposing end walls, and that the other of said mutually opposing end walls of the other pontoon has a complementary recess to accommodate the portion of the wheel projecting from the end wall of the first pontoon in an extended floating position of the pontoon pair.

7. The arrangement as claimed in claim 6, including two pontoon pairs mutually pivotably connected, in a manner known per se, at a second hinge line pivot means parallel to said first-mentioned hinge line pivot means of the two pontoon pairs, and situated adjacent the undersides of the pontoons, and that each pontoon pair has at least one wheel.

8. The arrangement as claimed in claim 7, wherein said wheels are arranged in the pontoons situated farthest from each other.

9. The arrangement as claimed in claim 7, wherein the two central pontoons of the two pontoon pairs are each provided with a chamber.

* * * * *